US005373540A

United States Patent [19]

DeCooman, Sr. et al.

[11] Patent Number: 5,373,540

[45] Date of Patent: Dec. 13, 1994

[54] SPENT NUCLEAR FUEL SHIPPING BASKET

[75] Inventors: William J. DeCooman, Sr., Lynchburg, Va.; Jean F. Lafleur, Chassieu, France

[73] Assignee: The United States of America as represented by the United States Department of Energy, Washington, D.C.

[21] Appl. No.: 164,232

[22] Filed: Dec. 8, 1993

[51] Int. Cl.[5] ..... G21F 5/008

[52] U.S. Cl. ..... 376/272; 250/507.1

[58] Field of Search ..... 376/272; 250/506.1, 250/507.1

[56] References Cited

U.S. PATENT DOCUMENTS 4,382,060 5/1983 Holtz et al. ..... 376/272

4,770,844 9/1988 Davis, Jr. ..... 376/272

5,114,666 5/1992 Ellingson et al. ..... 376/272

*Primary Examiner*—Daniel D. Wasil

*Attorney, Agent, or Firm*—Robert J. Edwards; D. Neil LaHaye

[57] ABSTRACT

A spent nuclear fuel shipping basket. A shell has a lower wall section of greater thickness than the remainder of the shell and a plurality of notches spaced apart around its inner circumference and extending the length of said shell. A plurality of drain holes are provided in the lower end plate of the shell. A plurality of cruciforms are sized to receive fuel cans. The cruciforms are formed from a neutron absorber and heat transfer material. Ring supports are spaced apart along the length of the shell and receive and transfer operating loads from the fuel cans to the shell and the shipping cask that receives the basket.

7 Claims, 3 Drawing Sheets

SPENT NUCLEAR FUEL SHIPPING BASKET

BACKGROUND OF THE INVENTION

1. Field of the Invention

The present invention is generally related to the shipment of nuclear fuel and particularly to a basket for shipping spent nuclear fuel.

2. General Background

Spent nuclear fuel is commonly stored at a site other than where the fuel was used in a commercial reactor. This requires the use of special shipping containers for the spent fuel. This is also true for spent nuclear fuel from naval vessels. The shipping containers are normally formed from a cask and a basket received in the cask that receives the fuel. The cask is normally required to prevent radiation loss to the surrounding environment, to serve as a heat sink for removing heat generated by the nuclear fuel, and to minimize shock loads transferred to the fuel in the event of an accident during transportation. The shipping basket received in the cask is normally required to act in conjunction with the cask to retain the fuel in the loaded pattern, minimize shock transfer to the fuel, transfer heat to the cask, and provide criticality control. Typically, a cask is heavily shielded. The shipping basket typically utilizes spacing geometry, neutron poisons, and limits the quantity of fuel carried to provide criticality control. This presents a problem of limiting the amount of spent fuel that can be loaded into one shipping basket and cask. This presents a need for a shipping basket that is able to receive a greater volume of spent fuel while still providing criticality control to help reduce the number of shipping baskets and casks required when shipping spent nuclear fuel.

SUMMARY OF THE INVENTION

The present invention addresses the above need in a straightforward manner. What is provided is a spent nuclear fuel shipping basket that combines several critical individual components into one component to increase payload while reducing shipping weight. A cruciform formed from a neutron absorber placed between fuel cans acts as a neutron absorber, a heat conductor, and provides geometry control of the fuel cans. Support wafers in the basket shell provide structural support and transfer heat from the cruciform to the shell, which transfers heat to the cask.

DETAILED DESCRIPTION OF THE PREFERRED EMBODIMENT

Figure 1:
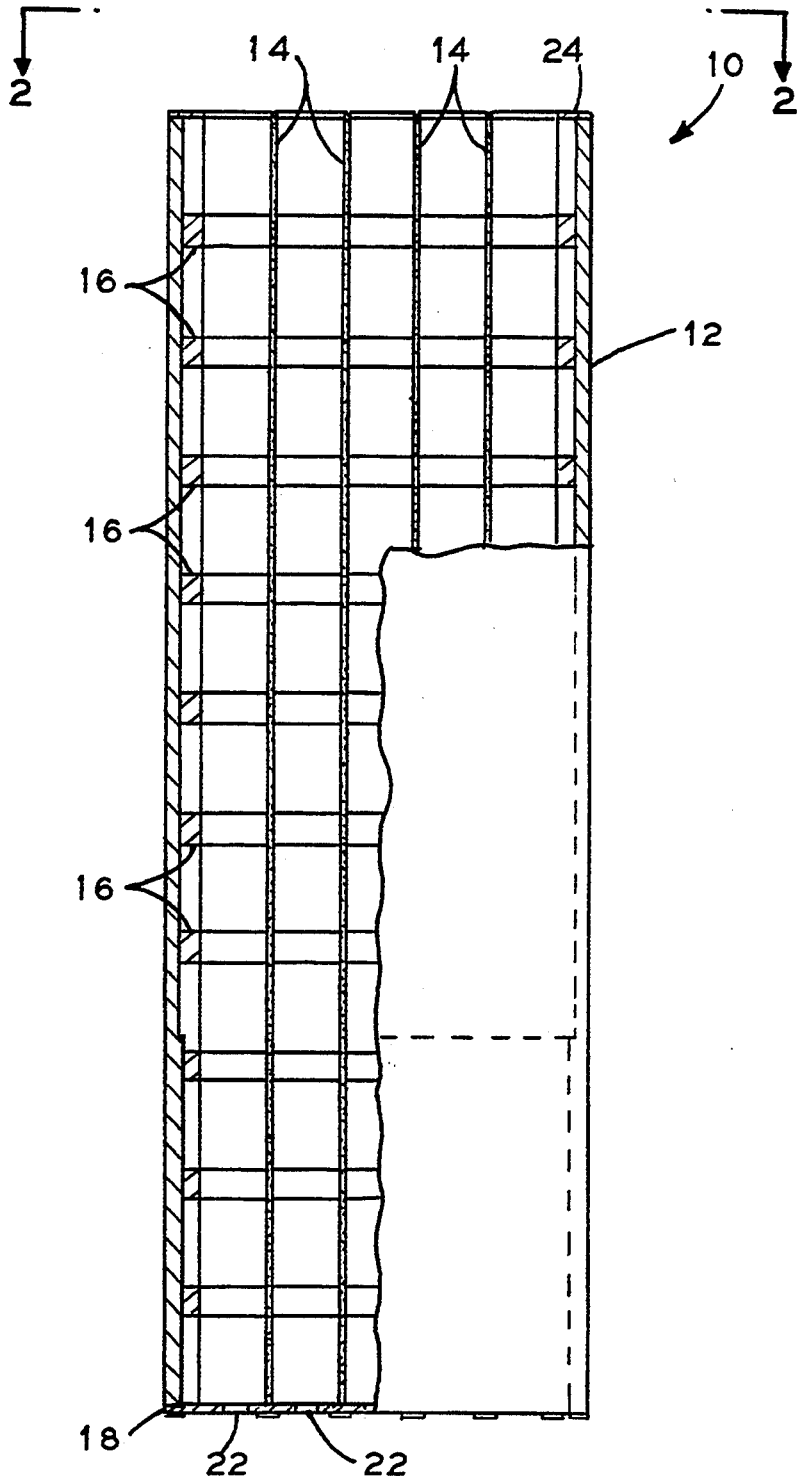
FIG. 1 is a longitudinal partial sectional view of the invention.
Figure 2:
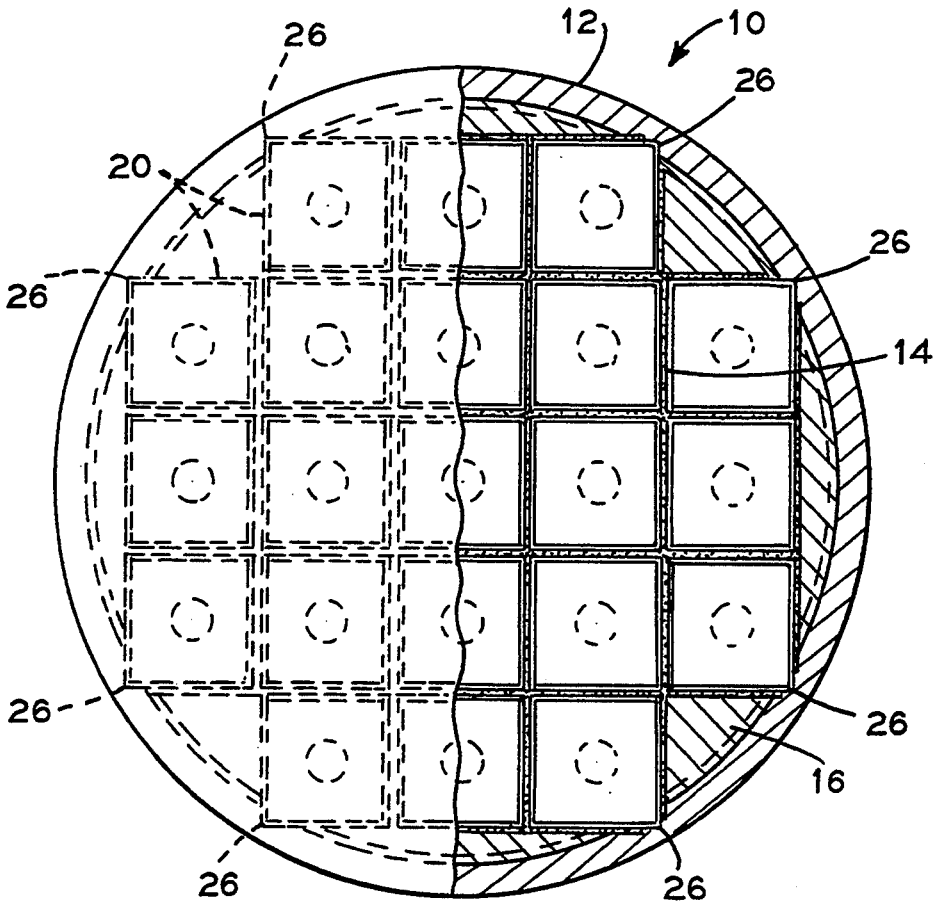
FIG. 2 is a partial sectional view taken along the lines 2—2 of FIG. 1.

Referring to the drawings, it is seen in FIG. 1 and 2 that the invention is generally indicated by the numeral 10. Spent nuclear fuel shipping basket 10 is generally comprised of shell 12, cruciforms 14, and ring supports 16.

Shell 12 is provided with end plate 18 at its lower end to support fuel cans 20 that are loaded in shell 12. Drain holes 22 are provided across end plate 18 to allow drainage of any liquid from fuel cans 20 that may accumulate in shell 12. Cover plate 24 is provided for the top end of shell 12. Shell 12 is preferably formed from stainless steel. As seen in FIG. 1, the lower end of shell 12 is provided with a thicker wall section than the upper wall section to allow for shielding at the portion of basket 10 that would normally receive the end fittings of a fuel assembly. This provides for integral shielding without the need for additional parts and weight. As seen in FIG. 2, shell 12 may be notched on the interior diameter as indicated by the numeral 26 for receiving fuel cans 20. Notches 26 provide for radial clearance of fuel cans 20 within shell 12 and allow for thermal growth differences between shell 12 and cans 20. Notches 26 also allow the internal loads of cans 20, the payload, neutron absorber material dead weight, and operating and accident loads to be reacted into shell 12 with a more uniform load distribution than could be achieved with a strict corner point contact with cans 20.

Figure 3:
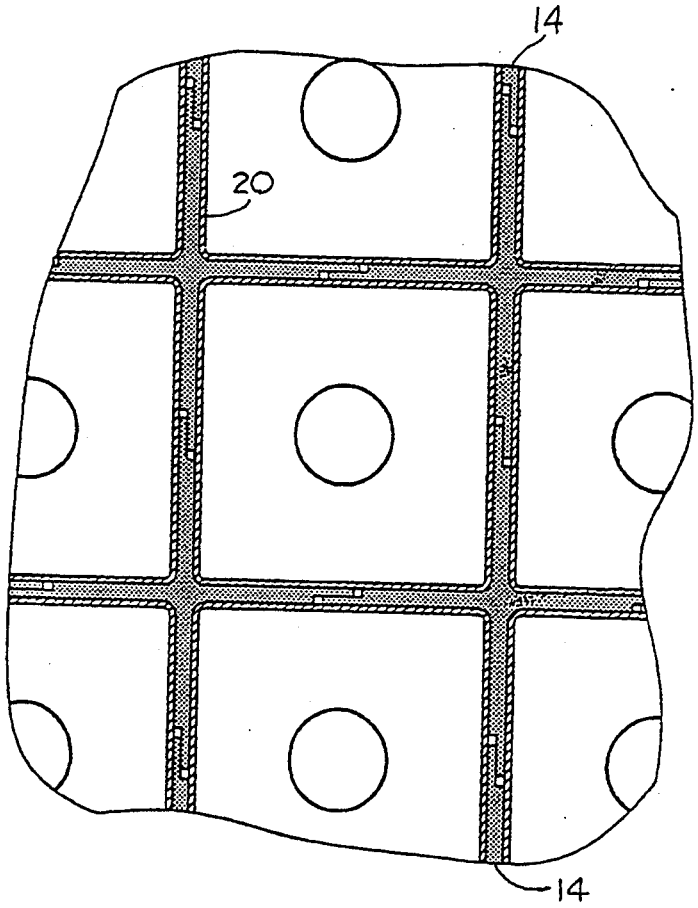
FIG. 3 is an enlarged detail view of FIG. 2 that illustrates the cruciform arrangement.

A plurality of cruciforms 14 best seen in FIG. 3 are provided to fit between fuel cans 20. The ends of each cruciform 14 are L-shaped to provide a complementary fit of adjacent cruciforms. As seen in FIG. 1, cruciforms 14 extend the full axial length of shell 12. Cruciforms 14 are formed from material suitable to serve the purposes of providing criticality control, acting as a heat transfer material to transfer heat from the interior of shell 12 to its exterior, and also aiding in maintaining geometry control of the spent nuclear fuel assemblies in conjunction with shell 12. In the preferred embodiment, cruciforms 14 are formed from borated aluminum alloy but may be formed from any other suitable material such as borated copper. Cruciforms 14 are sized to receive fuel cans 20 while maintaining contact with fuel cans 20 to provide effective heat transfer.

A plurality of ring supports 16 are spaced apart axially along the length of shell 12 and are shaped to fit the contour of cans 20 loaded into shell 12 for effective operating and accident load transfer to shell 12. In the preferred embodiment, ring supports 16 are formed from aluminum alloy.

In operation, shipping basket 10 is designed to increase payload while reducing shipping weight and may be used with any suitable shipping cask. The configuration is designed to transmit normal operating and accident loads from the payload by stainless steel fuel cans 20 through ring supports 16 to shell 12 and into the shipping cask.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A spent nuclear fuel shipping basket, comprising:

a. a shell having a lower wall section having a greater thickness than the remainder of said shell;

b. a plurality of cruciforms extending the length of said shell to receive fuel cans, said cruciforms being formed from a neutron absorber and heat transfer material; and c. a plurality of ring supports spaced apart along the length of said shell such that said ring supports transfer any operating loads to said shell.

2. The shipping basket of claim 1, wherein said shell is provided with a plurality of notches spaced apart around its inner circumference and extending the length of said shell.

3. The shipping basket of claim 1, wherein said shell is provided with an end plate at one end having a plurality of drain holes.

4. The shipping basket of claim 1, wherein said cruciforms are formed from borated aluminum alloy.

5. A spent nuclear fuel shipping basket, comprising:

a. a shell, said shell having a lower wall section having a greater thickness than the remainder of said shell and a plurality of notches spaced apart around its inner circumference and extending the length of said shell;

b. a plurality of cruciforms extending the length of said shell to receive fuel cans, said cruciforms being formed from a neutron absorber and heat transfer material; and c. a plurality of ring supports spaced apart along the length of said shell such that said ring supports transfer any operating loads to said shell.

6. The shipping basket of claim 5, wherein said shell is provided with an end plate at one end having a plurality of drain holes.

7. The shipping basket of claim 5, wherein said cruciforms are formed from borated aluminum alloy.

* * * * *